United States Patent [19]

Fukuroi et al.

[11] Patent Number: 4,768,263

[45] Date of Patent: Sep. 6, 1988

[54] AUTOMATIC LOCK SLIDER FOR SLIDE FASTENER

[75] Inventors: Takeo Fukuroi; Ichiro Terasaki, both of Uozu, Japan

[73] Assignee: Yoshida Kogyo K. K., Tokyo, Japan

[21] Appl. No.: 69,313

[22] Filed: Jul. 2, 1987

[30] Foreign Application Priority Data

Jul. 4, 1986 [JP] Japan ..... 61-158318
Feb. 20, 1987 [JP] Japan ..... 62-38622

[51] Int. Cl.[4] ..... A44B 19/30

[52] U.S. Cl. ..... 24/418; 24/419; 24/421

[58] Field of Search ..... 24/418, 419, 420, 421, 24/422, 429, 424

[56] References Cited

U.S. PATENT DOCUMENTS

| | | | |
|---|---|---|---|
| 1,778,338 | 10/1930 | Prentice . | |
| 1,862,196 | 7/1932 | Norton . | |
| 2,271,141 | 1/1942 | Lange | 24/424 |
| 2,532,367 | 12/1950 | Lyeth . | |
| 2,540,693 | 2/1951 | Shur | 24/419 |
| 2,571,024 | 10/1951 | Feitl . | |
| 2,913,795 | 11/1959 | Brown | 24/421 |
| 3,262,172 | 7/1966 | Scheuerman | 24/421 |
| 3,823,446 | 7/1974 | Labecki | 24/418 |
| 4,081,883 | 4/1978 | Ishii et al. | 24/421 |
| 4,102,022 | 7/1978 | Aoki | 24/421 |
| 4,130,918 | 12/1978 | Ishii et al. | 24/419 |
| 4,139,928 | 2/1979 | Aoki et al. | 24/424 |
| 4,422,220 | 12/1983 | Oda | 24/421 |

FOREIGN PATENT DOCUMENTS

| | | | |
|---|---|---|---|
| 0656328 | 12/1964 | Belgium | 24/421 |
| 0523277 | 3/1956 | Canada | 24/421 |
| 0686590 | 5/1964 | Canada | 24/419 |
| 0059370 | 8/1982 | European Pat. Off. . | |
| 1213747 | 9/1974 | France . | |
| 2350807 | 5/1976 | France . | |
| 51-126703 | 10/1976 | Japan . | |
| 0153841 | 3/1956 | Sweden | 24/420 |
| 602543 | 5/1948 | United Kingdom . | |
| 943136 | 11/1963 | United Kingdom . | |

*Primary Examiner*—Victor N. Sakran
*Attorney, Agent, or Firm*—Hill, Van Santen, Steadman & Simpson

[57] ABSTRACT

An automatic lock slider for a slide fastener includes a locking prong spring-biased to protrude into a Y-shaped guide channel in a slider body. The locking prong is urged downwardly to engage a coupling head of a coupling element in an intermeshing region where the mating pair of coupling elements are brought into and out of intermeshing engagement. The locking prong is urged against the coupling head to effect locking of the slider.

11 Claims, 7 Drawing Sheets

FIG. 17
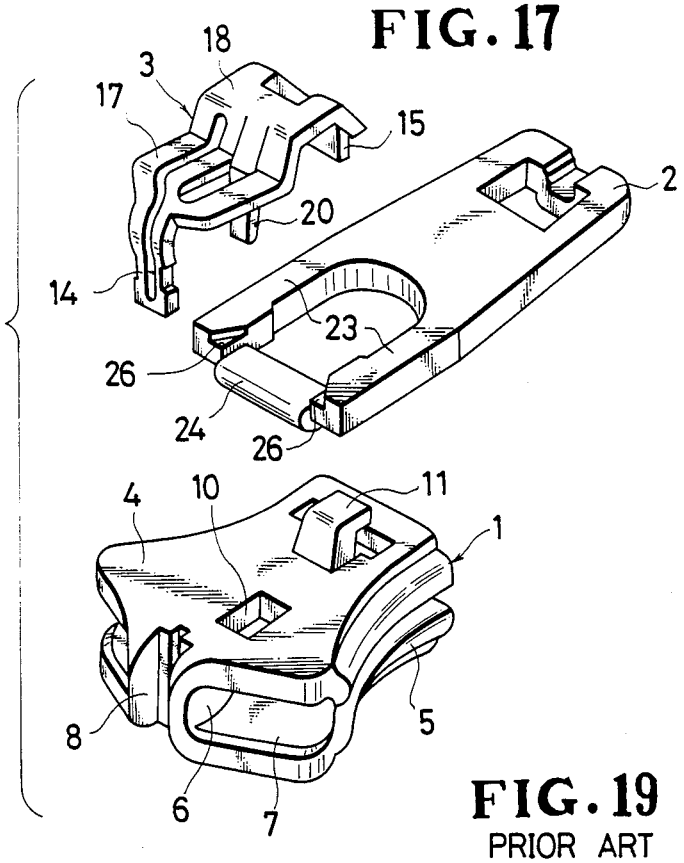
FIG. 19
PRIOR ART
FIG. 18
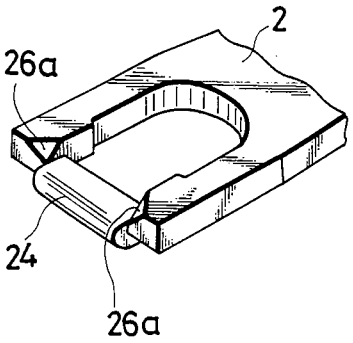
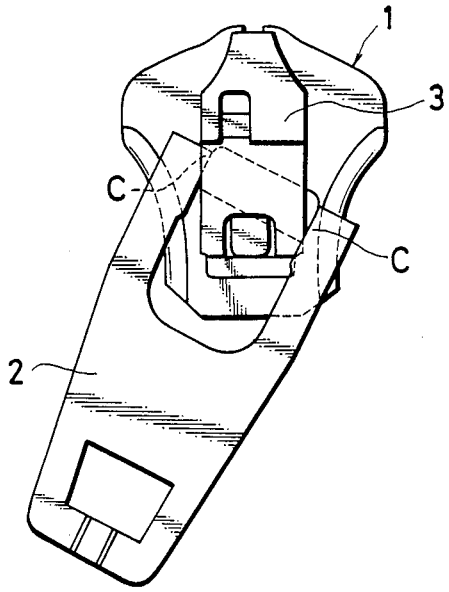

AUTOMATIC LOCK SLIDER FOR SLIDE FASTENER

BACKGROUND OF THE INVENTION

1. Field of the Invention:

The present invention relates to an automatically lockable slider for a slide fastener and more particularly a slider having a locking prong spring-biased to engage with a coupling head of a coupling element at an intermeshing region in its Y-shaped guide channel.

2. Prior Art:

A typical automatic lock slider for a slide fastener includes a pull tab and a locking prong operatively associated therewith. The locking prong is normally urged downwardly into the path of coupling elements in the slider, and can be retracted out of the path by lifting the pull tab on the slider.

As is often the case with slide fasteners having such sliders and used on a rigid garment fabric, they are opened by grabbing the garment fabric and spreading the fastener stringers forcibly apart instead of manipulating the pull tab on the slider. A similar scene is commonly witnessed at the site of sewing slide fasteners to the rigid garment fabric, namely a denim.

Japanese Utility Model Laid-Open Publication No. 51-126703 discloses a lockable slider having lock and ratchet functions. To effect the ratchet function, a cavity is defined in the bottom surface of the guide channel in confrontation with the locking prong so as to allow the coupling element to tilt and sink therein to pass underneath the prong when the fastener stringers are forcibly spread apart.

With this type of slider, the maximum allowable lock strength of the locking prong is defined by a critical pressure at which the coupling elements begin to shift out of position on the fastener or otherwise sustain damage. This means that the coupling element does not initiate tilting until it is engaged by the locking prong with considerable force nearly reaching the critical pressure. Under the influence of such pressure, the locking prong is susceptible to abrasion, which in turn makes the slider malfunction or be unlockable. Another problem with this prior slider is that it is difficult to attain the necessary dimensional precision in the finish of its parts.

SUMMARY OF THE INVENTION

It is an object of the present invention to provide an improved lock slider which is capable of smooth lock and ratchet performance over extended service life without involving separated, displaced or damaged fastener elements which would otherwise result from repeated ratchet action.

The above object is achieved by the provision of a lock slider having a locking prong spring-biased toward a predetermined region at which the prong confronts these fastener elements which are on the verge of coupling together or uncoupling from each other adjacent to a diverging point of a Y-shaped guide channel in the slider body, the locking prong having its lower end configured to enable pressure-engagement with a coupling head portion of the element.

According to one aspect of the present invention, a slider for a slide fastener comprises a slider body including upper and lower wings spaced from each other and joined together at their front ends by a neck thereby defining a Y-shaped guide channel therebetween, a locking member supported on said slider body and including a locking prong movable through an aperture in said upper wing into and out of the guide channel, a pull tab pivotally mounted on said slider body, said locking prong being normally urged downwardly against the coupling elements in an intermeshing region of said guide channel in which the coupling elements are brought into and out of intermeshing engagement.

According to another aspect of the invention, a slider for a slide fastener comprises: a slider body; a locking member supported on the slider body; a pull tab supported on the slider body and having a cam shaft disposed between the locking member and the slider bcdy and normally urged to rotate so that the pull tab rests on the slider body; and the pull tab including bifurcated support legs having their end portions connected to opposite ends of the cam shaft, the cam shaft being disposed at a level downwardly offset relative to upper surfaces of the support legs, the end portions of the support legs each having a guide recess disposed at its inside corner for keeping a downward movement of the locking memebr free from being blocked by either of the support legs.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 17 is an explosive view of an another modification of the slider fastener;

FIG. 18 is a perspective view of modified parts of the slider shown in FIG. 17; and FIG. 19 is a schematical plan view of a prior slider, showing a pull tab laterally angularly displaced relative to a slider body.

The invention will be better understood from the following detailed description taken in conjunction with the accompanying drawings, in which like numerals refer to like and corresponding parts throughout the several views.

DETAILED DESCRIPTION

Figure 1:
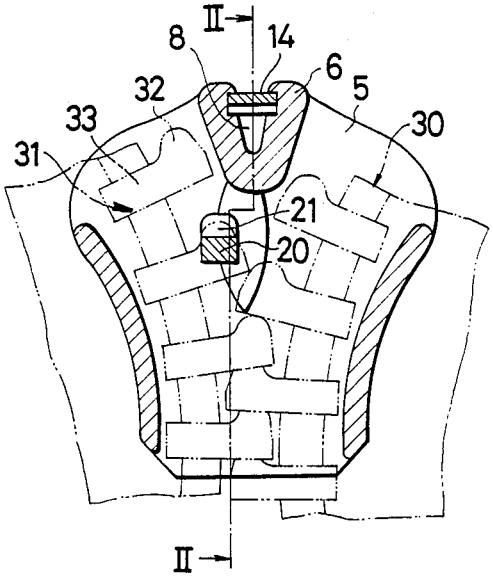
FIG. 1 is a horizontal cross-sectional view of a slider according to an embodiment of the present invention, with a locking prong in a locking mode.

FIGS. 1–4 show inclusively an automatic lock slider according to a first embodiment of the present invention. The slider includes a slider body 1, a locking member 3 mounted on the slider body and a pull tab 2 pivotably held by the locking member on the slider body.

The slider body 1 includes upper and lower wings 4, 5 spaced in parallel to each other and a connecting neck 6 joining together the two wings at their front ends, thereby defining a Y-shaped guide channel 7 for the passage of a pair of coupling element rows 31 carried respectively on a pair of stringer tapes. The neck extends vertically and has a V-shaped horizontal cross section such that it defines a retention groove 8 for receiving one end of the locking member 3 as descrived later on.

The upper wing has two apertures 10, 12 both communicating with the guide channel 7. One, or the; front, aperture 10 is disposed adjacent to the neck 6 and the other or rear aperture 12 is disposed adjacent to the rear end of the upper wing 4. The front aperture 10 is disposed at a position laterally displaced from a longitudinal axis of the slider body 1 for the purpose described later on. Formed between the two apertures 10, 12 is a retaining lug 11.

The locking member is made of a resilient material such as a metal plate and includes a downwardly curved front portion 14, an intermediate portion 17 extending rearwardly from an upper curved part 16 of the front portion and a bulged portion 18 contiguous to the intermediate portion.

The locking member 3 is retained at the distal end 15 of the front portion 14 received in the retention groove 8 such that the intermediate portion 17 and the bulged portion 18 are urged toward the upper wing 4. Specifically, a lower surface 17*a* of the intermediate portion 17 is urged downwardly and facewise against the upper wing 4. The distal end 15 is engaged by a pair of stepped portions 9 formed at a lower end of the groove. The locking member extends rearwardly and terminates in a rear end 19 disposed in the rear aperture 12 of the upper wing. The locking member has a window 22 defined in a rear slanted wall of the bulged portion 18. The retaining lug 11 extends upwardly rearwardly through the window 22 and terminates above the rear end 19 of the locking member 3 such that the lug 11 restricts an excessive movement of the locking member in both lateral and upward directions.

Figure 2:
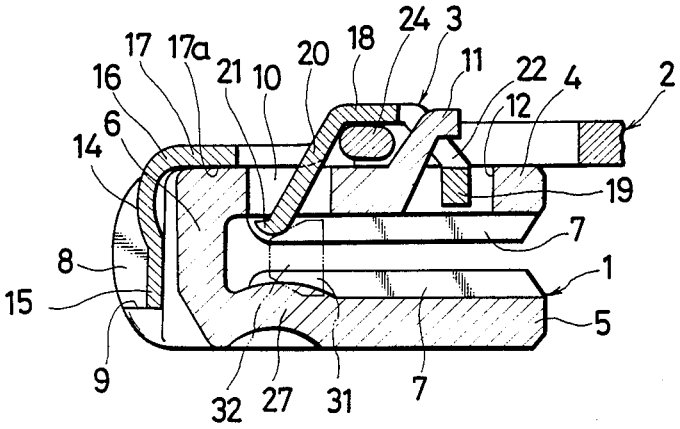
FIG. 2 is a vertical cross-sectional view taken along line II—II of FIG. 1.

A locking prong 20 extends downwardly forwardly from the intermediate portion 17 through the laterally displaced front aperture 10 into the guide channel 7 as shown in FIG. 2. The locking prong 20 has its lower end 21 normally positioned in an intermeshing region defined adjacent to a diverging or branched point of the Y-shaped guide channel 7, in which region a mating pair of coupling elements are brought into and out of intermeshing engagement by moving the slider relative to the coupling element rows.

More specifically, the intermeshing region is an area where the mating pair of coupling elements are on the verge of coupling together or on the verge of separating from each other.

The lower end 21 of the locking prong 20 has an abutment surface on its lower end at somewhat rear surface. The abutment surface is defined by a rounded or smooth surface at which the locking prong engages a tapered surface of the coupling head 32 of the coupling element 31.

The prong 20 and hence the lower end 21 are normally urged downwardly toward the lower wing 5 since the intermediate portion 17 supporting the same is urged downwardly.

Provision of the smooth abutment surface on the locking prong prevents the coupling elements from being damaged or displaced by the repeated manipulation of the slider in its ratchet mode.

In the illustrated embodiment, the coupling element is in a discrete form, and has the tapered coupling head projecting forwardly. However, coupling element is not limited to this type.

Figure 5A:
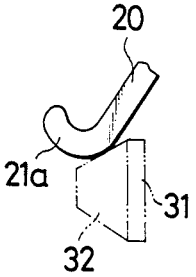
FIG. 5A, 5B and 5C are side elevational views of various lower ends of the locking prong according to embodiment of the invention.
Figure 5B:
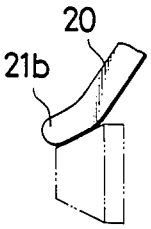
Figure 5C:
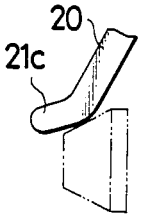

FIGS. 5A, 5B and 5C show exemplary forms of the lower end of the locking prong 20. In FIG. 5A, the locking prong 20 has an upwardly curved end 21*a* providing the abutment surface in the form of a rounded lower surface. FIG. 5B shows a lower bent end 21*b* having a lower surface engageable with a tapered surface of the coupling head 32 in a surface-contacting manner. FIG. 5C shows a lower bent end 21*c* having a lower rounded corner defining the abutment surface.

Figure 4:
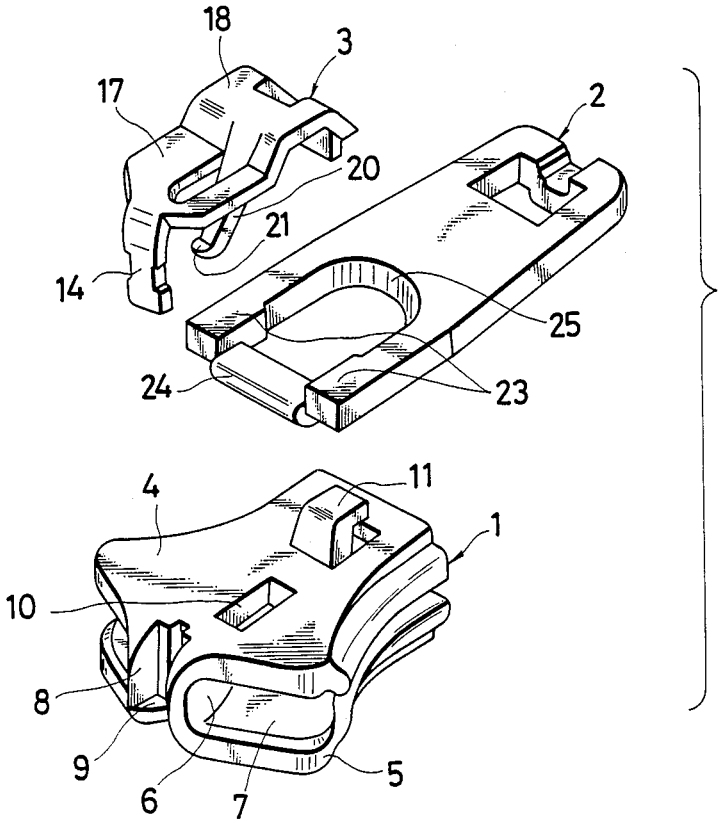
FIG. 4 is an explosive view of the slider of FIG. 1.

As shown in FIG. 4, the pull tab 2 has bifurcated support legs 23 and a cam shaft 24 extending between distal ends of the legs 23, thereby defining an opening 25. The cam shaft 24 is received in the bulged portion 18 and held against the upper wing 4 such that the pull tab is pivotally movable about the cam shaft 24 and also biased by the retention force of the bulged portion 18 to lie on the upper wing 4 of the slider body 1.

The locking prong 20 is normally spring-biased downwardly and is adapted to engage with a coupling head 32 of the coupling element 31 in the intermeshing region. When the locking prong 20 is in a locking position (FIG. 2) where the locking prong 20 is positioned in engagement with the coupling element 31, the prong continues to push down the coupling element for thereby locking the slider.

In a normal unlocking operation, the pull tab is manually raised to retract the locking prong 20 out of the guide channel. More specifically, the pivotal movement of the pull tab 2 causes the cam shaft to rotate to move the bulged portion 18 and hence the locking prong 20 upwardly. At this time, the lower end 21 of the prong 20 is retracted out of the guide channel 7. When the pull tab 2 is released, the cam shaft 24 is urged by the bulged portion 18 to rotate to cause the pull tab 2 to lie on the upper wing 4 of the slider body 2, whereupon the locking prong 20 is also urged down into the guide channel.

Figure 3:
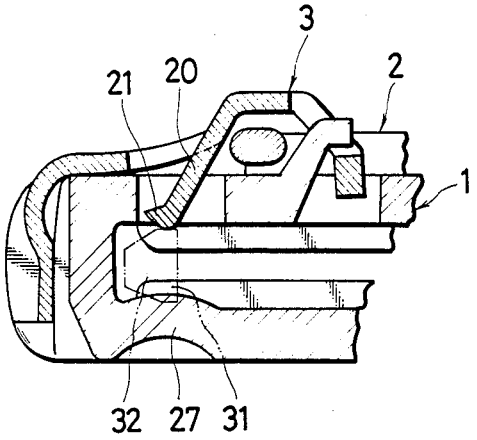
FIG. 3 is similar to FIG. 2, showing the locking prong in a ratchet mode.

Most importantly the slide fastener can be spread open also by pulling laterally the fastener stringers 30, 30 without manipulating the slider. Under the continued pull force applied to the stringers, the coupling element 31 is moved forwardly relative to the slider body 1 and hence the locking prong, whereupon the coupling head 32 slides on the smooth abutment surface of the prong 20 and advances pushing up the latter gradually as shown in FIG. 3. Consequently, the coupling element 31 clears the prong 20 and thus effecting a ratchet function. The successive coupling elements repeat the same action for thereby making the slide fastener spead apart.

During this operation the coupling element 31 are engaged at their coupling heads 32 by the locking prong 20. Provision of the abutment surface of the prong 20 protects the coupling elements from mechanical damages such as a shifting or a wearing of the coupling elements which otherwise take place.

Figure 6:
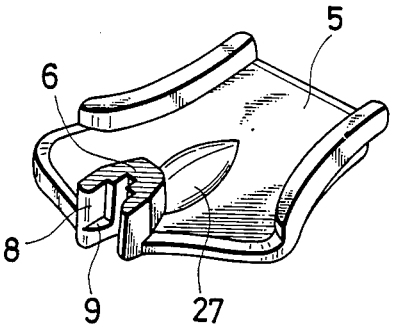
FIG. 6 is a perspective view of a lower wing of a slider body provided with a raised guide portion.
Figure 7:
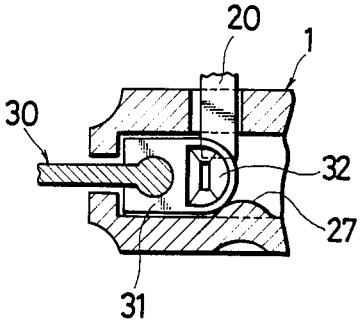
FIG. 7 is a vertical cross-sctional view of the slider, showing a manner in which the coupling element is forced against the raised portion.

As best shown in FIG. 6, a raised guide portion 27 is formed on the inner surface of the lower wing 5 of the slider body 1. The raised guide portion 27 is disposed in the intermeshing region of the guide channel 7 in a substantially vertical registry with the lower end 21 of the prong. The raised portion extends complementary in contour with a lower part of the coupling head 32 so as to occupy a gap between the coupling head 32 and the inner surface of the lower wing 5 i.e. the bottom surface of the guide channel 7, as shown in FIG. 7.

The raised portion 27 guides the coupling elements 31 and prevents the same to roll about its longitudinal axis of the coupling element in the intermeshing region as the latter advance on and along the raised portion 27 with the coupling heads 32 engaged by the locking prong 20. The raised portion 27 assists the locking prong 20 in locking the element 31 in a more stable manner.

Figure 8:
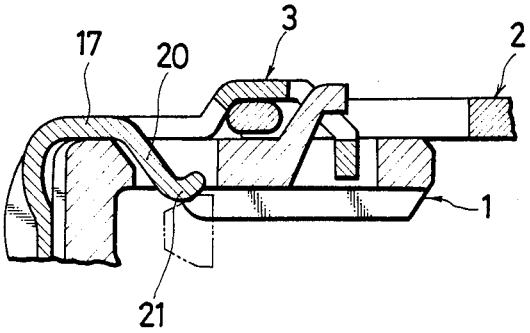
FIGS. 8 and 9 are vertical cross-sectional views, partly broken away, of modifications of the locking prong.
Figure 9:
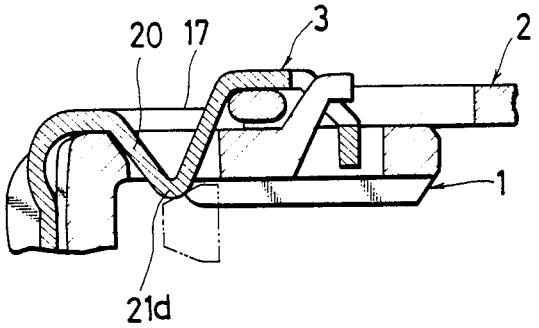

The locking prong 20 may extend down rearwardly from the intermediate portion 17 as shown in FIG. 8. FIG. 9 shows another modified locking prong 20 of a V-shape formed by punching the intermediate portion 17.

Figure 10:
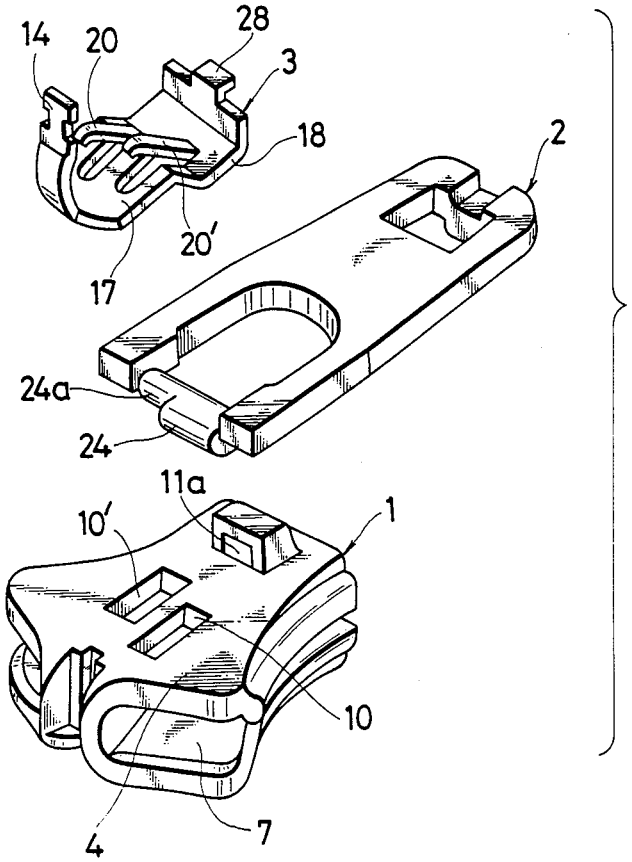
FIG. 10 is an explosive view of a modified slider having a pair of locking prongs.
Figure 11:
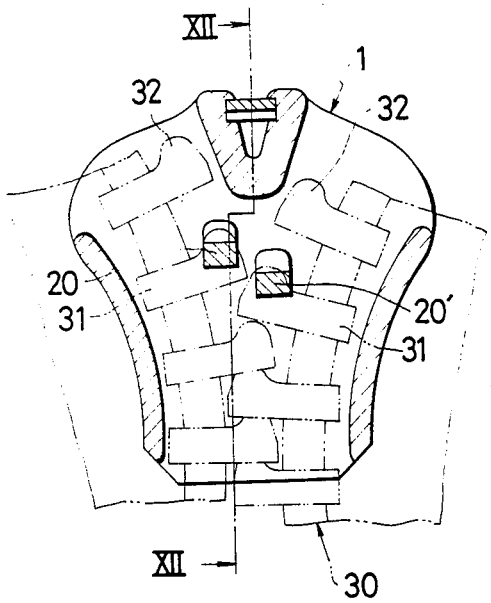
FIG. 11 is a horizontal cross-sectional view of the slider of FIG. 10.
Figure 12:
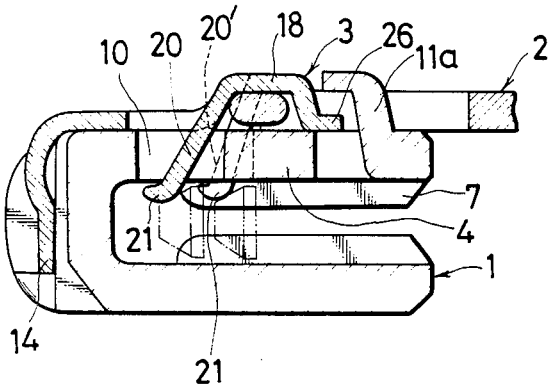
FIG. 12 is a vertical cross-sectional view taken along line XII—XII of FIG. 11.

The slider may be provided with an additional locking prong 20′ as shown in FIGS. 10, 11 and 12. The locking prong 20′ extends through an aperture 10′ of the upper wing 4 into the intermeshing region of the Y-shaped guide channel 7 in a similar manner to the locking prong 20 except that the additional prong 20′ is offset rearwardly relative to the prong 20 such that the locking rpong 20 engages one coupling element 31 and the locking prong 20′ engages the mating coupling element 31 as best shown in FIG. 11.

The cam shaft 24 has a recessed shaft portion 24*a* so as not to interfere with the rearwardly offset prong 20′. A retaining lug 11*a* of the upper wing 4 projects upwardly forwardly for the same purpose of the lug 11.

Figure 13:
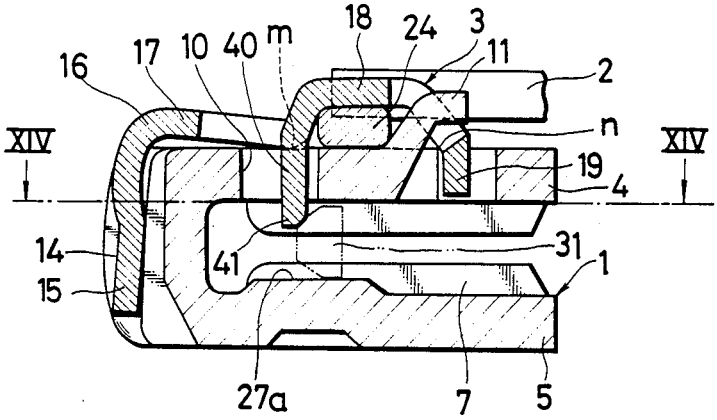
FIG. 13 is a vertical cross-sectional view of a slider according to another embodiment of the invention.
Figure 14:
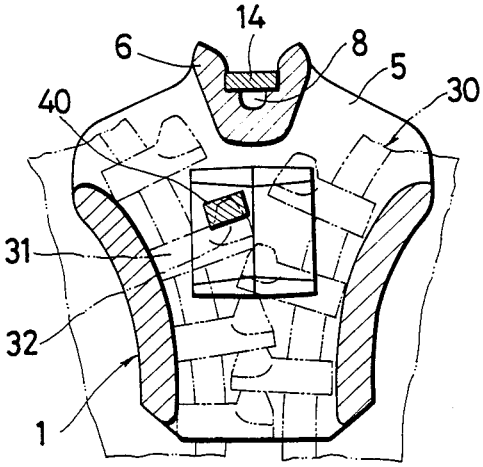
FIG. 14 is a horizontal cross-sectional view taken along line XIV—XIV of FIG. 13.
Figure 15:
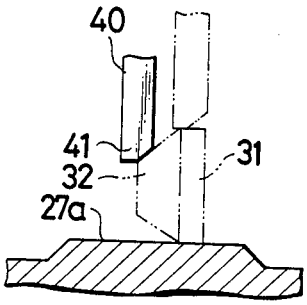
FIG. 15 is a side elevational view of a locking prong of the slider shown in FIG. 13, showing a manner in which the locking prong locks the coupling element.

FIGS. 13 to 16 show an automatic lock slider according to other embodiment of the invention. This embodiment is similar to those described hereinabove, but a locking prong 40 extends vertically down into the guide channel 7 through the aperture 10. An upper part 16 of the front portion 14 and the intermediate portion 17 are spaced from the slider body 1 as shown in FIG. 13. The prong 40 depends from a junction at which the intermediate portion 17 and the bulged portion 18 connected to each other.

The locking member 3 is urged against the upper wing 4 and in contact with the latter at points m, n. The point m is disposed at the junction between the intermediate portion 17 and the bulged portion 18, and the point n is disposed on an inner surface of a rear slanted wall of the bulged portion 18. The locking member is spring-biased and pivotally movable about the distal end 15, for thereby projecting the locking prong 40 into the guide channel 7. A lower end 41 of the prong 40 is positioned in the intermeshing region in a similar manner as the prong 20. The lower end 41 has a rearwardly canted surface defining the abutment surface engageable with a forwardly tapered surface of the coupling head 32.

The locking prong 40 has a rectangular horizontal cross section and is twisted about its axis such that the rectangle is orientated in the same direction as the coupling head 32 of the coupling element 31 positioned in contact with the lower end 41 of the prong in the intermeshing region. In other words a rear side face of the rectangular prong 40 extends in parallel to a longitudinal axis of a leg 33 of the coupling element 31.

Figure 16:
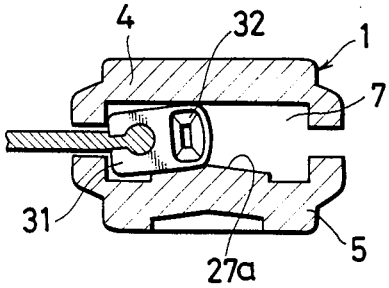
FIG. 16 is a vertical cross-sectional view of the slider of FIG. 13, showing the coupling element positioned on the raised portion.

A raised guide portion 27*a* is formed on the inner surface of the lower wing 7 in the intermeshing region. As best shown in FIG. 16, the raised portion 27*a* has a pair of laterally slanted surfaces having a ridge coaxial with the axis of the slider body 1. The raised portion 27*a* makes the guide channel 7 receive and guide the coupling elements 1 in a more snugly manner.

The downward movement of the locking prong 40 is restricted by the upper wing 4 which engages the prong at the points m, n, and the upward movement of the same by the retention lug 11 which engages the rear end 19 thereof.

The vertical locking prong 40 is lifted by the horizontal or forward pushing force of the coupling element 31 in more efficient and more responsive manner than the slanted locking prong 20. This is because the prong 40 is pivotable about a point, i.e. the distal end of the locking member 15, which is disposed relatively remotely from the prong. The more remotely the distal end or pivot portion of the locking member is disposed from the prong or action point, the more responsively the prong is moved by the force caused thereon by the coupling element when the latter is forced to move through the guide channel.

FIGS. 17 and 18 show modifications of the pull tab 2. When the pull tab 2 is released from the operator's fingers in a vertical unlocking position, the pull tab is forced to lie down under the biase force of the locking member 3 through the cam effect of the cam shaft 24. On such occasion the pull tab is apt to fall down into a laterally displaced position as shown in FIG. 19, and the distal end portions of the legs 23 are often clinched between the locking member 2 and the upper wing of the slider body 1. As a result, the locking prong is blocked and kept retracted from the guide channel 7 as indicated by a phantom line in FIG. 15, although the pull tab is in the horizontal locking position. This is because the cam shaft 24 is disposed offset downwardly relative to the upper surface of the legs 23 and hence of the pull tab 2.

To avoid such an objectionable interference of the legs 23, the pull tab 2 of FIG. 17 is provided with a pair of stepped guide recesses 26, 26 at respective inside corners of the distal ends of the legs 23. The guide recess may be in the form of a canted corner recess 26*a* as shown in FIG. 18.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An automatic lock slider for a slide fastener having a pair of rows of coupling elements, comprising:

(a) a slider body including upper and lower wings spaced from each other and joined together at their front ends by a neck so as to define therebetween a Y-shaped guide channel for the passage of the coupling elements, said Y-shaped guide channel including a branched point in which branched point a mating pair of coupling elements are brought into and out of intermeshing engagement as they pass through said guide channel;

(b) a locking member of resilient material supported on said slider body and including a locking prong movable through an aperture in said upper wing into and out of said guide channel;

(c) a pull tab pivotally mounted on said slider body and operatively connected with said locking member for moving said locking prong upwardly against the resiliency of said locking member; and (d) said locking prong having a lower end normally disposed in said guide channel immediately upstream of said branched point and urged downwardly, under the resiliency of said locking member, for abutment on a coupling head of one of two mating coupling elements which are about to intermeshingly engage with each other.

2. An automatic lock slider according to claim 1, said locking prong having a smooth abutment surface disposed at its lower end and normally urged against said coupling head.

3. An automatic lock slider according to claim 1, said lower wing having a raised guide portion disposed on its inner surface in said intermeshing region for guiding the coupling element to prevent the latter from rolling about its axis.

4. An automatic lock slider according to claim 1, said locking prong extending in a downwardly slanted fashion.

5. An automatic lock slider according to claim 1, said locking prong extending vertically downwardly.

6. An automatic lock slider according to claim 1, said locking member including a front portion having its distal end retained at the neck of said slider body, and an intermediate portion extending integrally from an upper curved part of said front portion and supporting said locking prong, said upper part being spaced from said slider body, said intermediate portion having its lower surface being normally urged facewise against said upper wing.

7. An automatic lock slider according to claim 1, said locking member including a downwardly curved front portion having its distal end retained at the neck of said slider body, and an intermediate portion extending integrally from an upper curved part of said front portion and supporting said locking prong, said upper curved part of said front portion and a major part of said intermediate portion being spaced from said slider body such that said locking member is pivotally movable about said distal end thereof.

8. An automatic lock slider according to claim 1, said locking member including an intermediate portion supporting said locking prong, said intermediate portion having an abutment point disposed adjacent to said locking prong and normally engaged by said upper wing for restricting a downward movement of said locking prong.

9. An automatic lock slider according to claim 1, said lower end of said locking prong having a rectangular horizontal cross section, a rear side of which cross section being in parallel to an axis of said one coupling element in said intermeshing region.

10. An automatic lock slider according to claim 1, said locking member further including additional locking prong being movable into and out of said guide channel, said additional locking prong being offset with respect to the first-named locking prong in an axial direction of said guide channel such that, in said intermeshing region, said first-named locking prong engages one coupling element of one coupling element row while said additional locking prong engages a mating coupling element of the other coupling element row.

11. An automatic lock slider for a slide fastener having a pair of coupling elements rows comprising:

(a) a slider body including upper and lower wings spaced from each other and joined together at their front ends by a neck, thereby defining a Y-shaped guide channel therebetween;

(b) a locking member supported on said slider body and including a locking prong, movable through an aperture in said upper wing adjacent said neck and into and out of the guide channel for abutment on a coupling head of one of two mating coupling elements which are about to intermeshingly engage with each other;

(c) a pull tab pivotally movably mounted on said slider body and having a cam shaft sandwiched between said locking member and said slider body and biased downwardly by said locking member to rotate so that the pull tab rests on said slide body; and (d) said pull tab including bifurcated support legs having their end portions connected respectively to opposite ends of said cam shaft, said cam shaft being disposed at a level downwardly offset relative to upper surfaces of said support legs, said end portions of said support legs each having a guide recess disposed at its inside corner.

* * * * *